US005381616A

United States Patent [19]

Disney

[11] Patent Number: 5,381,616

[45] Date of Patent: Jan. 17, 1995

[54] ROTARY ROCKWHEEL ASSEMBLIES

[75] Inventor: Robin E. L. Disney, Malvern, United Kingdom

[73] Assignee: R. & R. Trench Equipment Limited, Malvern, England

[21] Appl. No.: 927,395

[22] PCT Filed: Mar. 22, 1991

[86] PCT No.: PCT/GB91/00435

§ 371 Date: Sep. 28, 1992

§ 102(e) Date: Sep. 28, 1992

[87] PCT Pub. No.: WO91/14836

PCT Pub. Date: Oct. 3, 1991

[30] Foreign Application Priority Data

Mar. 27, 1990 [GB] United Kingdom ..... 9006781

[51] Int. Cl.[6] ..... E02F 5/08; E02F 5/14

[52] U.S. Cl. ..... 37/94; 37/189; 37/355

[58] Field of Search ..... 37/348, 362, 355, 94, 37/189, 462, 907, 104, 270, 91; 405/180, 181, 183, 174; 172/832, 387

[56] References Cited

U.S. PATENT DOCUMENTS

| | | | |
|---|---|---|---|
| 2,336,487 | 12/1943 | Lewis et al. | 37/94 X |
| 3,206,877 | 9/1965 | Metailler | 37/362 |
| 4,110,920 | 9/1978 | Brown | 37/189 X |
| 4,324,056 | 4/1982 | Sommerfeld | 37/189 X |
| 4,750,280 | 6/1988 | Dalaine . | |
| 4,852,946 | 8/1989 | Hackmack . | |
| 5,058,294 | 10/1991 | Bryan, Jr. | 37/189 X |

OTHER PUBLICATIONS

"Cutting at a Dash", New Civil Engineering, Mar. 9, 1989, by R. Byles, pp. 30–31.

A photograph of a Mastenbroek trencher. Date unknown.

"Kukla Boasts of Unbeatable New Range in Trenchers", *Construction News*, Oct. 1987, p. 13.

"C Series Rock Trencher and Rockwheel", four pages. Date unknown.

*Primary Examiner*—Randolph A. Reese
*Assistant Examiner*—Spencer Warnick
*Attorney, Agent, or Firm*—Young & Thompson

[57] ABSTRACT

A rotary rockwheel assembly (1) is provided for cutting a narrow trench in the ground when driven along the ground by a vehicle. The assembly (1) comprising a support frame (14), ground-engaging skids (17) on the support frame (14) permitting the support frame to be moved in the direction in which the trench is to be cut, and a rotary cutting wheel (2) carried by the support frame (14). A hydraulic drive motor (8) rotates the cutting wheel (2) about a substantially horizontal axis, and pivot rams (18) serve to lower the cutting wheel (2) relative to the support frame (14) from a raised position in which substantially the whole of the cutting wheel (2) is above the surface (5) of the ground to a lowered position in which a substantial part of the cutting wheel (2) is sunk into the ground in a trench (33) cut by the cutting wheel (2). Such an assembly is capable of cutting a trench in a particularly efficient manner.

10 Claims, 2 Drawing Sheets

FIG 1
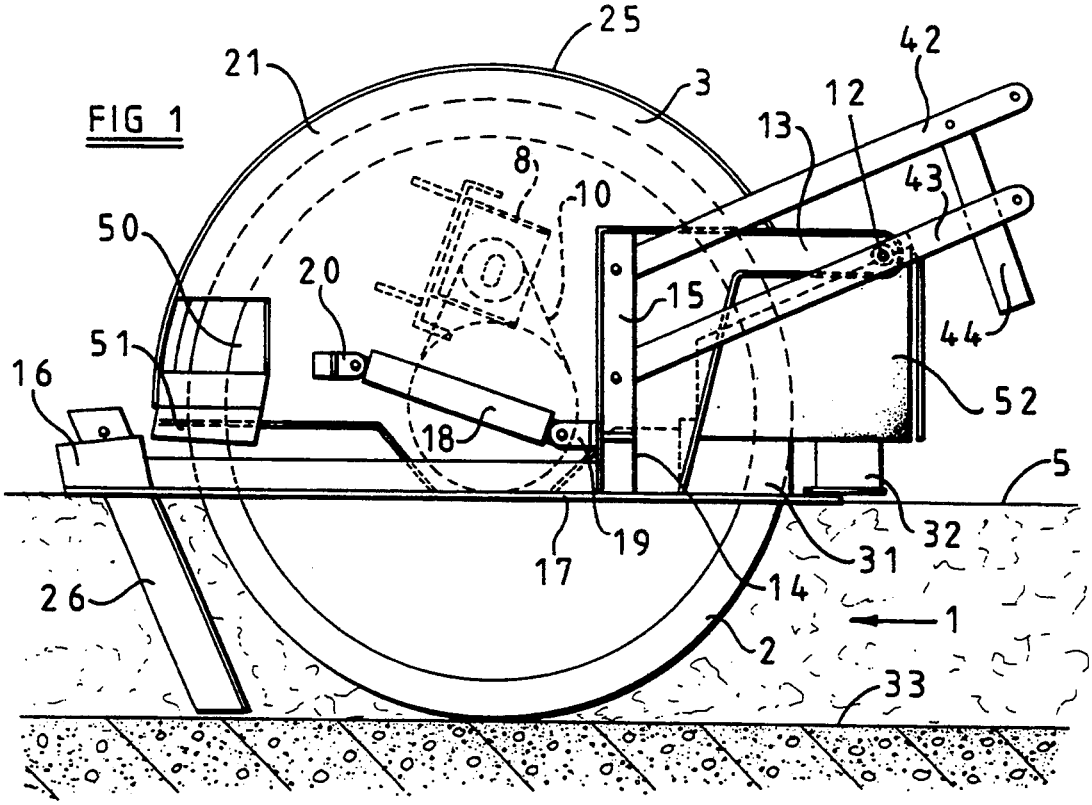
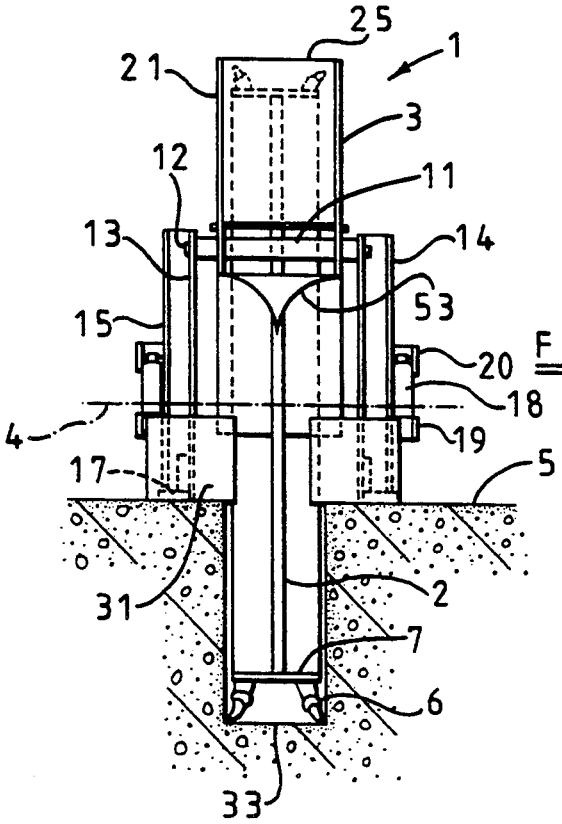
FIG 2

ROTARY ROCKWHEEL ASSEMBLIES

FIELD OF THE INVENTION

This invention relates to rotary rockwheel assemblies which serve to cut a narrow trench in the ground when driven along the ground by a vehicle.

BACKGROUND OF THE INVENTION

It is known to use a rotary rockwheel assembly pulled by a tractor for cutting a narrow trench in the ground, for example for installation of television cables and other services beneath the surface of a road or pavement. The cutting wheel of such an assembly has a plurality of carbide teeth attached to its outer rim and is driven in a clockwise or anti-clockwise direction by the power take-off from the tractor. Furthermore the cutting wheel is supported by the tractor by way of a pivot linkage permitting the rotating cutting wheel to be lowered into the ground to commence cutting of the trench. The tractor may then be moved forward as rotation of the cutting wheel continues so as to continue cutting of the trench. However, there are certain disadvantages associated with such rockwheel assemblies in use. Because the cutting wheel is directly carried by the pivot linkage shock and vibration are transmitted from the cutting wheel to the linkage and to the tractor, and there is a tendency for the depth of trench to vary uncontrollably. Furthermore when used for cutting through the surface of a tarmac road or pavement such assemblies produce trenches having ragged edges due to the fact that the cutting wheel has a tendency to break away stones at the edges of the trench. This means that, in many applications, it is necessary to subsequently smooth the edges of the trench in a separate operation using an inclined saw. This significantly increases the trench cutting costs.

U.S. Pat. No. 2,403,367 discloses a rotary rockwheel assembly in which the cutting wheel is carried by a support arrangement such that the cutting wheel may be lowered relative to the support arrangement for cutting, and in which a skid is pivotally secured to the support arrangement to track a sufficient distance from the trench being cut so as to avoid breaking in of the edges of the trench. However, because the support arrangement is not supported on the ground by the skid, there is still substantial transmission of shock and vibration from the cutting wheel to the linkage and the tractor.

It is an object of the invention to provide an improved rotary rockwheel assembly which is capable of cutting a trench in a particularly efficient manner.

SUMMARY OF THE INVENTION

According to the present invention there is provided a rotary rockwheel assembly for cutting a narrow trench in the ground when driven along the ground by a vehicle, the assembly comprising a support frame, ground-engaging means on the support frame permitting the support frame to be moved in the direction in which the trench is to be cut, a rotary cutting wheel carried by the support frame, drive means for rotating the cutting wheel about a substantially horizontal axis, and lowering means on the support frame for lowering the cutting wheel relative to the support frame from a raised position in which substantially the whole of the cutting wheel is above the ground to a lowered position in which the cutting wheel cuts into the ground while being rotated by the drive means, wherein the support frame is supported on the ground by the ground-engaging means while the cutting wheel cuts into the ground so that the reaction forces generated by the cutting action are transmitted by way of the ground-engaging means into the ground.

Such an assembly is capable of cutting a trench in a particularly efficient manner by virtue of the fact that the reaction forces generated by the cutting action of the cutting wheel are transmitted by way of the ground-engaging means to the ground, rather than producing undesirable vibration of the assembly detrimental to the tractor or the linkage coupling the rockwheel assembly to the tractor.

Preferably the ground-engaging means comprises ground-engaging members which are adapted to engage the ground along the opposing edges of the trench being cut. The ground-engaging members are advantageously constituted by two skids disposed one on each side of the cutting wheel, although they may also be constituted by ground-engaging wheels. The ground-engaging means may comprise a single skid which surrounds the wheel and is adapted to engage the ground on opposite sides of the trench being cut.

BRIEF DESCRIPTION OF THE DRAWINGS

In order that the invention may be more fully understood, a preferred embodiment of the invention will now be described, by way of example, with reference to the accompanying drawings, in which:

FIG. 1 is a schematic side view of the assembly;

FIG. 2 is a front view of the assembly with the cutting wheel being shown in vertical section.

DETAILED DESCRIPTION OF THE INVENTION

Figure 3:
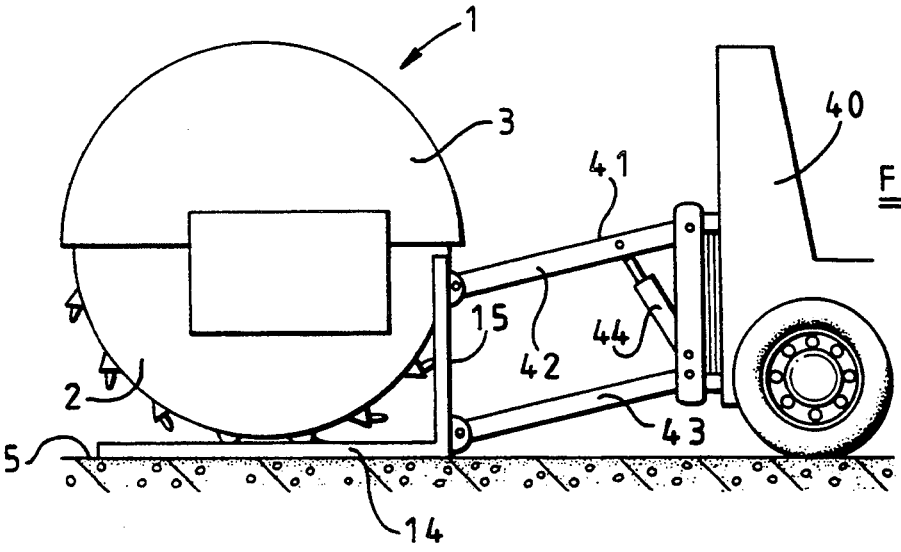
FIGS.3, 4 and 5 are diagrammatic side views of the assembly coupled to a tractor in three possible operational positions.

Referring to FIGS. 1 and 2, the rotary rockwheel assembly 1 comprises a cutting wheel 2 mounted within a sub-frame 3 so as to be rotatable about a horizontal axis 4 parallel to the surface 5 of the ground. The cutting wheel 2, which is shown in vertical section in FIG. 2, has two rows of carbide teeth 6 attached to its outer rim 7, and is driven clockwise or anti-clockwise by a hydraulic drive motor 8 coupled to the drive shaft of the cutting wheel 2 by a 2.5:1 chain drive mechanism 10.

The cutting wheel 2 and associated drive motor 8 are supported within the sub-frame 3 which is welded at its front (towards the right in FIG. 1) to a transverse tube 11 (shown in FIG. 2). Furthermore a pivot pin 12 extends through the tube 11 and through side cheeks 13 of a ground-engaging support frame 14 between which the sub-frame 3 is positioned so as to permit pivoting of the sub-frame 3 about the pivot pin 12 within the support frame 14. Each of the side cheeks 13 is welded to a respective upright 15 and ground-engaging skid 17 of the support frame 14 on the associated side of the cutting wheel 2, and the two skids 17 on opposite sides of the cutting wheel 2 are connected together by a cross-member 16 at the rear of the cutting wheel 2 and additionally by a cross-member (not illustrated) at the front of the wheel 2. In addition a respective pivot ram 18 on each side of the cutting wheel is pivotally connected at 19 to the associated upright 15 of the frame 14 and is pivotally connected at 20 to the sub-frame 3, and is extensible and contractable to pivot the sub-frame 3 between a raised position and a lowered position (shown in FIGS. 1 and 2).

The sub-frame 3 comprises, on each side of the cutting wheel 2, a respective side cheek 21, and the two side cheeks 21 are joined together by an arcuate sheet 25 which extends between the side cheeks 21 over the top of the cutting wheel 2. Furthermore a crumber 26 extends through a clamp box constituting the cross-member 16 and is slidable within the clamp box so as to be adjustable in height in dependence on the depth of the trench 33 being cut. The crumber 26 serves to clear the soil from the bottom of the trench 33.

A respective aperture 50 is provided at the rear of each side cheek 21 of the sub-frame 3, and associated chutes 51, and chevrons (not illustrated) within the sub-frame 3, serve to discharge spoil outwardly of the sub-frame 3 and to deposit the spoil onto the ground, rather than into the trench. In addition rubber flaps 52 are provided on the side cheeks 13 of the support frame 14 to prevent the spoil thrown up by the cutting wheel 2 from flying forwardly of the assembly to present a hazard to operating personnel. A spoil guidance system 53 is provided within the sub-frame 3 at the front of the cutting wheel 2 to divide the spoil thrown up by the wheel 2 and guid it towards the two sides of the sub-frame 3.

Each of the skids 17 is fitted with a plough member 31, and optionally also with a 45 degree two-way spoil plough 32 for use when cutting through tarmac.

Figure 4:
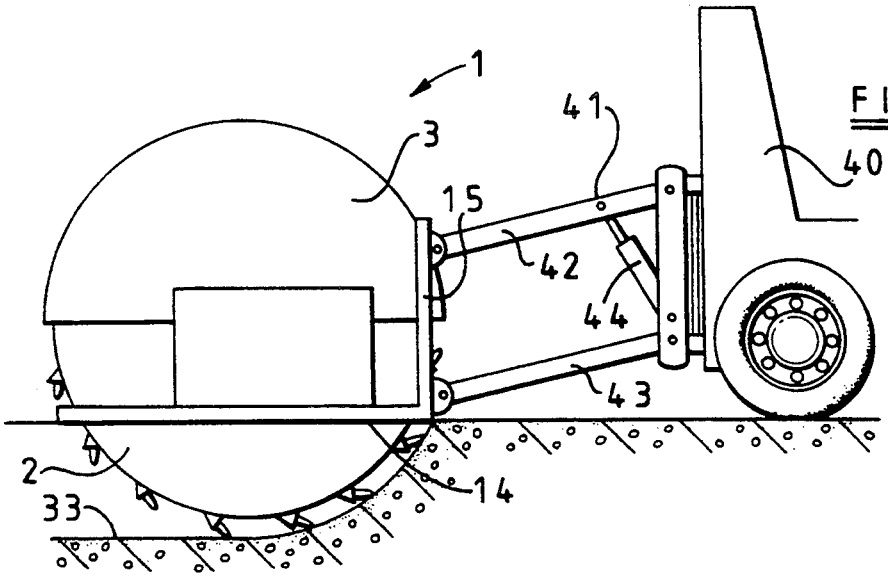
Figure 5:
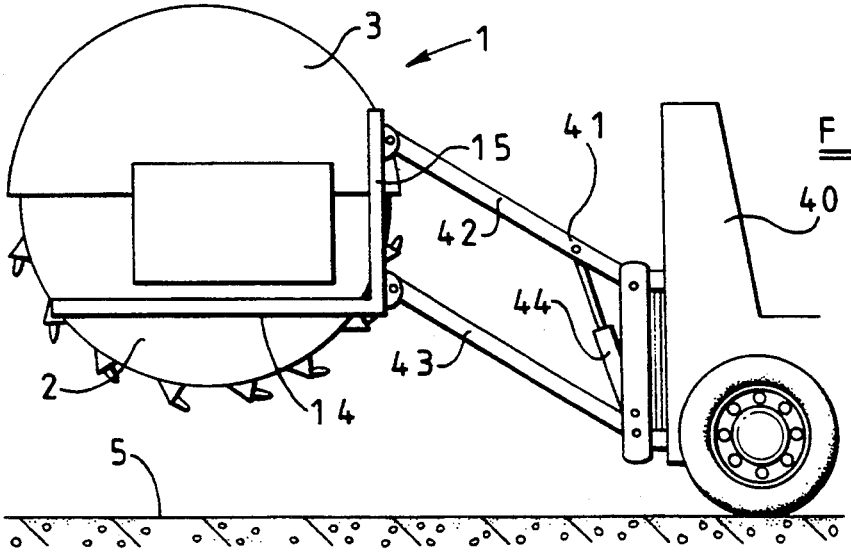

FIGS. 3, 4 and 5 show highly diagrammatical side views of the assembly 1 in three operational positions coupled to a tractor 40 by a pivot linkage 41. The pivot linkage 41 comprises a respective pair of parallel arms 42, 43 pivotally connected to each upright 15 of the frame 14 and pivotally connected to the tractor 40, and a respective lift ram 44 pivotally connected between the tractor 40 and each arm 42.

When a trench is to be cut, the assembly 1 is lowered by the lift rams 44 of the pivot linkage 41 into a ready-for-work position, shown in FIG. 3, in which the skids 17 on the support frame 14 engage the surface 5 of skids 17 on the support frame 14 engage the surface 5 of the ground. In this position the pivot rams 18 are fully extended so that the sub-frame 3 is in its raised position in which the cutting wheel 2 is held clear of the surface 5 of the ground.

After the cutting wheel 2 has been set in motion by the motor 8 which is driven from the power take-off of the tractor 40, the cutting wheel 2 is lowered into the ground to cut a trench 33 by contracting the pivot rams 18 to pivot the sub-frame 3 within the support frame 14. The depth of the trench 33 to be cut is determined by the degree to which the pivot rams 18 are contracted. The tractor 40 may then be moved forward as the cutting wheel 2 continues to rotate to thereby cut a continuous trench. During cutting the skids 17 with the fitted plough members 31 travel along the two edges of the trench 33 being cut, as best shown in FIG. 2.

After the required length of trench has been cut, the cutting wheel 2 may be lifted out of the ground by expanding the pivot rams 18 so that the assembly again assumes the position shown in FIG. 3. The lift rams 44 of the pivot linkage 41 may then be operated to lift the assembly 1 into a transport position clear of the surface 5 of the ground, as shown in FIG. 5, in which the assembly may be transported to another location whilst being carried on the back of the tractor 40. It is to be noted that, in this transport position, the pivot rams 18 are contracted so that the sub-frame 3 is in its lower pivotal position in order to lower the centre of gravity of the assembly during transport.

The above-described assembly is particularly advantageous in use for cutting a trench as the pivot rams 18 absorb and transmit all the shock loads produced by the cutting action of the cutting wheel 2 through the support frame 14 into the ground. Thus substantially no vibration or forces detrimental to the tractor 40 or pivot linkage 41 are transmitted by the assembly. The pivot linkage 41 enables the assembly to move vertically up and down relative to the tractor 40 during cutting of the trench to accommodate uneveness in the ground. Furthermore the cutting depth may be varied by the pivot rams 18 without the skids 17 leaving the ground and without permitting substantial forces to be transmitted to the tractor.

The assembly may be used for cutting trenches of varying widths and depths through different media, from soil to solid rock. Furthermore the pivot linkage can easily be mounted on a cross-slide and steering device to enable the assembly to be steered independently of the tractor. Furthermore the assembly can be fitted to different types of vehicle and can be used in association with different types of coupling linkage.

I claim:

1. A rotary rockwheel assembly for cutting a narrow trench in the ground when driven along the ground by a vehicle having a chassis, the assembly comprising a support frame connected to said chassis, ground-engaging means rigidly secured to the support frame permitting the support frame to be moved in the direction in which the trench is to be cut, a rotary cutting wheel carried by the support frame, drive means for rotating the cutting wheel about a substantially horizontal axis, and lowering means on the support frame for lowering the cutting wheel relative to the support frame and the ground-engaging means from a raised position in which substantially the whole of the cutting wheel is above the ground to a lowered position in which the cutting wheel cuts into the ground while being rotated by the drive means, wherein the support frame is supported on the ground by the ground-engaging means as the cutting wheel is simultaneously rotated by the drive means and lowered by the lowering means so as to cut into the ground, so that the reaction forces generated by the cutting action are transmitted by way of the ground-engaging means into the ground.

2. An assembly according to claim 1, wherein the ground-engaging means comprises ground-engaging members (33) which are adapted to engage the ground along the opposing edges of the trench being cut.

3. An assembly according to claim 2, wherein the ground-engaging members are constituted by two skids disposed one on each side of the cutting wheel.

4. An assembly according to claim 1, wherein the lowering means comprises a sub-frame carrying the cutting wheel and pivotally connected to the support frame, and pivoting means for pivoting the sub-frame relative to the support frame to move the cutting wheel between the raised position and the lowered position.

5. An assembly according to claim 4, wherein the pivoting means is constituted by at least one extensible and contractable ram pivotally connected between the support frame and the sub-frame.

6. An assembly according to claim 1, which includes a linkage for coupling the support frame to a vehicle and permitting vertical movement of the assembly relative to the vehicle and to the ground.

7. An assembly according to claim 6, wherein the linkage is a parallel arm linkage.

8. An assembly according to claim 1, which includes lifting means for lifting the assembly clear of the ground when it is to be transported by the vehicle.

9. An assembly according to claim 1, wherein the drive means comprises a hydraulic motor.

10. An assembly according to claim 1, wherein the drive means is coupled to the cutting wheel by a chain drive mechanism.

* * * * *